US007673630B2

(12) United States Patent
Kling

(10) Patent No.: US 7,673,630 B2
(45) Date of Patent: Mar. 9, 2010

(54) RESPIRATORY PROTECTION MASK FOR A COMPRESSED AIR BREATHING APPARATUS

(75) Inventor: Peter Kling, Berlin (DE)

(73) Assignee: MSA Auer GmbH (DE)

( * ) Notice: Subject to any disclaimer, the term of this patent is extended or adjusted under 35 U.S.C. 154(b) by 0 days.

(21) Appl. No.: 10/497,134

(22) PCT Filed: Sep. 10, 2002

(86) PCT No.: PCT/DE02/03420

§ 371 (c)(1),
(2), (4) Date: Oct. 18, 2004

(87) PCT Pub. No.: WO03/047698

PCT Pub. Date: Jun. 12, 2003

(65) Prior Publication Data

US 2005/0066966 A1 Mar. 31, 2005

(30) Foreign Application Priority Data

Nov. 27, 2001 (DE) ..... 101 59 219

(51) Int. Cl.
*A62B 18/10* (2006.01)

(52) U.S. Cl. ..... 128/207.12; 128/206.28; 128/206.21; 128/205.15; 128/206.12; 128/205.25; 128/205.24; 128/202.27; 128/201.22; 128/201.24; 128/201.23

(58) Field of Classification Search ..... 128/207.12, 128/206.28, 206.21, 206.15, 206.12, 205.25, 128/205.24, 202.27, 201.22, 201.24, 201.23, 128/205.15, 210.24
See application file for complete search history.

(56) References Cited

U.S. PATENT DOCUMENTS

| | | | | |
|---|---|---|---|---|
| 4,856,120 A | | 8/1989 | Hart | |
| 4,961,420 A | * | 10/1990 | Cappa et al. | 128/207.12 |
| 5,499,624 A | * | 3/1996 | Kruger et al. | 128/204.26 |
| 5,787,882 A | * | 8/1998 | Hamilton | 128/204.26 |
| 6,394,091 B1 | * | 5/2002 | Giorgini | 128/206.21 |

FOREIGN PATENT DOCUMENTS

| | | |
|---|---|---|
| DE | 695492 A | 8/1940 |
| DE | 1153258 B | 5/1961 |
| DE | 1945462 U | 9/1966 |
| EP | 0011682 A1 | 8/1979 |
| GB | 1215218 A | 12/1970 |

* cited by examiner

*Primary Examiner*—Patricia Bianco
*Assistant Examiner*—Nihir Patel
(74) *Attorney, Agent, or Firm*—Wood, Phillips, Katz, Clark & Mortimer

(57) ABSTRACT

A respirator for a compressed air breathing apparatus including a lung machine controlled by a control membrane and an expiratory valve with an air outlet. The air outlet of the expiratory valve and the control membrane of the lung machine are covered by a common lid spaced from the expiratory valve and control membrane, with there being at least one air discharge opening on the lid that forms a purging space around the control membrane through which air from the air outlet passes so as to move against the control membrane and to the at least one discharge opening.

20 Claims, 1 Drawing Sheet

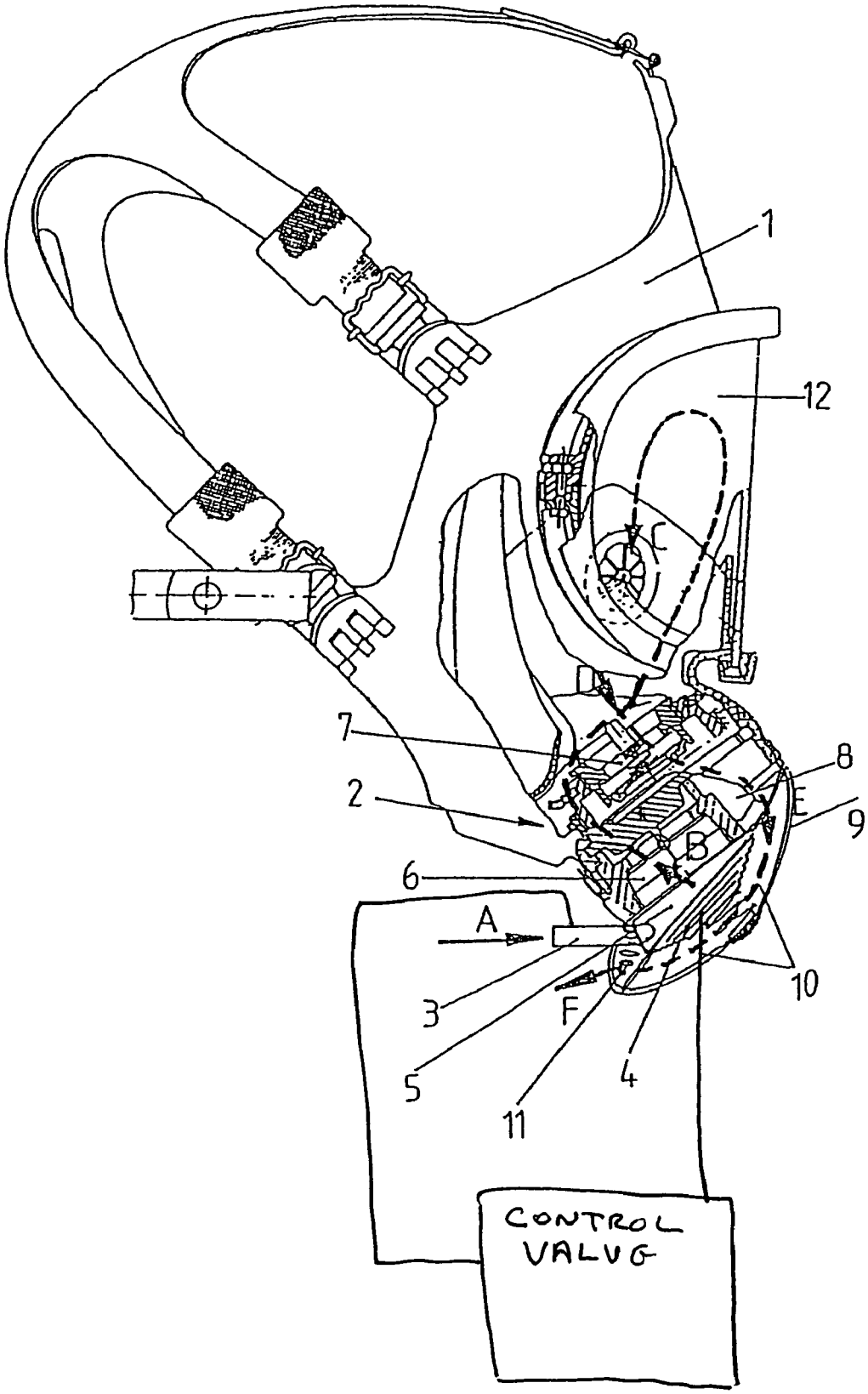
1
12
C
D
7
8
2
E
9
B
6
A
3
F
10
5
4
11
CONTROL
VALVE

RESPIRATORY PROTECTION MASK FOR A COMPRESSED AIR BREATHING APPARATUS

BACKGROUND OF THE INVENTION

1. Field of the Invention

This invention relates to a respirator mask for a compressed air breathing apparatus with a lung machine controlled by a control membrane and an expiratory valve with an air outlet.

2. Background Art

Respirator masks, when combined with a compressed air respirator, are typically operated with a lung machine that is connected to the facepiece by a screwed or plug-in connection. The air supply from a pressure reducer via a medium-pressure line is controlled by a control membrane operated by the mask wearer's inhaling that mechanically acts on a control valve which in turn releases the medium-pressure line as required. The thin membrane made of an elastic material is of course highly sensitive to environmental conditions involving extreme temperatures and aggressive media. The functioning of the membrane may be impaired, for example, by reduced elasticity in low temperatures which adversely affects resistance to breathing and sensitivity, or if the membrane material is penetrated, destroyed, or severely mechanically damaged by aggressive gases such as hydrogen sulfide or phosgene.

SUMMARY OF THE INVENTION

It is therefore the problem of the invention to design a respirator mask of the type mentioned at the outset in such a way that the functioning of the control membrane is not impaired by temperatures and aggressive media and thus a long service life is ensured.

This problem is solved according to the invention by a respirator mask comprising the characteristics described in claims 1 and 7. The dependent claims disclose further advantageous improvements of the invention.

The general concept of the invention is a common lid that covers the air outlet of the expiratory valve and the control valve and that comprises air discharge openings on the opposite side, i.e. the side facing away from the air outlet. Thus a purging space or duct is created in which the mask wearer's clean expiratory air flows at a homogeneous temperature from the air outlet across the surface of the control membrane and washes away the aggressive gases while keeping the membrane at an equal temperature, or cools or heats it depending on the outside temperature. This ensures undisturbed functionality and a long service life of the control membrane.

BRIEF DESCRIPTION OF THE DRAWING

An embodiment of the invention will be explained in greater detail below with reference to the only FIGURE showing a partial sectional view of a respiratory mask with a lung machine attached to it.

The facepiece 1 is equipped with a lung machine 2 for supplying respiratory air to the wearer of the mask from a compressed air reservoir via a pressure reducer and a medium-pressure line 3. Air supply is controlled according to the rhythm of breathing by an inhale-operated control membrane 4 that is connected via a linkage to a control valve (not shown) that opens the medium-pressure line 3 when the wearer inhales. Arrows A, B, and C show the path of the inhalation air along the dashed line from the medium-pressure line 3 via the chamber 5 and the air inlet 6 of the lung machine and along the visor panels 12 to the wearer of the mask while the used air is exhaled in the direction of arrows D, E, and F through the expiratory valve 7. As can be seen in the FIGURE, the air the wearer of the mask exhales does not immediately flow outside but through an air outlet 8 into the purging space 10 defined by the lid 9 above the control membrane 4. This means that clean and homogeneously tempered purging air, i.e. the exhalation air of the wearer of the mask, is conducted across the surface of the control membrane 4 with each exhalation cycle. This keeps the control membrane 4 at an equal temperature regardless of the outside temperature so that its functioning is neither limited by high nor by low outside temperatures. The control membrane 4 becomes neither too rigid nor too soft but keeps its predefined mechanical properties. Breathing conditions remain optimal for the wearer of the mask even under extreme conditions. Furthermore, aggressive toxic gases such as hydrogen sulfide or phosgene that can diffuse the thin control membrane relatively fast and harm the wearer of the equipment are continuously washed away from the control membrane 4 thereby eliminating the risk of impairment and ensuring a long service life and purity of the inhalation air. The exhaled fair (purging air) is discharged through air discharge openings 11 in the lid 9.

The invention claimed is:

1. A respirator mask for compressed air breathing apparatus comprises a lung machine; wherein the lung machine comprises a control membrane and an expiratory valve with an air outlet; wherein the air outlet of the expiratory valve and the control membrane are covered by a common lid spaced from the expiratory valve and the control membrane and there is at least one air discharge opening on the common lid; the common lid forming a purging space around the control membrane; air from the air outlet passing through the purging space so as to move against the control membrane and to the at least one discharge opening; the control membrane separating independent inhalation and exhalation paths, wherein air moves in the inhalation path against the control membrane to a user and from a user through the exhalation path to the air outlet.

2. The respirator mask according to claim 1, wherein the lid is spaced a small distance from the control membrane to separate the control membrane from the ambient atmosphere.

3. The respirator mask according to claim 2, wherein the lid is either a) an integral part of at least one of the lung machine or the respirator mask or b) separately attached to at least one of the lung machine or respirator mask.

4. The respirator mask according to claim 2 wherein the lid is spaced substantially an equal distance from the control membrane around the control membrane.

5. The respirator mask according to claim 1, wherein the lid is either a) an integral part of at least one of the lung machine or the respirator mask or b) separately attached to at least one of the lung machine or respirator mask.

6. The respirator mask according to claim 1 wherein the at least one air discharge opening comprises a plurality of air discharge openings facing away from the air outlet.

7. The respirator mask for a compressed air breathing apparatus according to claim 1 wherein air does not move through the control membrane as the air moves in the inhalation path to a user and from a user in the exhalation path to the air outlet.

8. The respirator mask for a compressed air breathing apparatus according to claim 1 wherein the expiratory valve is spaced from the control membrane.

9. The respirator mask for a compressed air breathing apparatus according to claim 1 wherein the control membrane has first and second opposite surfaces, air moves against the first surface in the inhalation path and against the second surface in the exhalation path.

10. The respirator mask for a compressed air breathing apparatus according to claim 9 wherein the entirety of the second surface is at all times spaced from the lid.

11. A respirator mask for compressed air breathing apparatus comprises a lung machine; wherein the lung machine comprises a control membrane and an expiratory valve with an air outlet; wherein a purging space bounded by a lid and communicating through at least one discharge opening to the ambient atmosphere is formed around the control membrane, and air from the air outlet is guided by the lid to move against and past the membrane to and from the at least one discharge opening, wherein the expiratory valve is spaced and separate from the control membrane and resides between where a user exhales air and the air outlet, wherein the air does not move through the control membrane.

12. The respirator mask for a compressed air breathing apparatus according to claim 11 wherein the lid is spaced a small distance from the control membrane to separate the control membrane from the ambient atmosphere.

13. The respirator mask for a compressed air breathing apparatus according to claim 12 wherein the lid is either a) an integral part of at least one of the lung machine or the respirator mask or b) separately attached to at least one of the lung machine or respirator mask.

14. The respirator mask for a compressed air breathing apparatus according to claim 12 wherein the lid is spaced substantially an equal distance from the control membrane around the control membrane.

15. The respirator mask for a compressed air breathing apparatus according to claim 11 wherein the lid is either a) an integral part of at least one of the lung machine or the respirator mask or b) separately attached to at least one of the lung machine or respirator mask.

16. The respirator mask for a compressed air breathing apparatus according to claim 11 wherein the at least one discharge opening comprises a plurality of discharge openings facing away from the air outlet.

17. The respirator mask for a compressed air breathing apparatus according to claim 11 wherein the control membrane has first and second opposite surfaces, and air moves in separate paths against the first surface and the second surface and the entirety of the second surface is at all times spaced from the lid.

18. A respirator mask for compressed air breathing apparatus comprises a lung machine; wherein the lung machine comprises a control membrane and an expiratory valve with an air outlet; wherein a purging space bounded by a lid and communicating through at least one discharge opening to the ambient atmosphere is formed around the control membrane, and air from the air outlet is guided by the lid to move against and past the membrane to and through the at least one discharge opening, wherein air moves against the control membrane to a user and from a user against the control membrane and to the air outlet without passing through the control membrane.

19. The respirator mask for a compressed air breathing apparatus according to claim 18 wherein the expiratory valve is spaced from the control membrane.

20. The respirator mask for a compressed air breathing apparatus according to claim 18 wherein the control membrane has first and second opposite surfaces, and air moves in separate paths against the first surface and the second surface and the entirety of the second surface is at all times spaced from the lid.

* * * * *